United States Patent [19]

Kato

[11] 4,289,332

[45] Sep. 15, 1981

[54] RECORDING SHEET

[75] Inventor: Hajime Kato, Fujinomiya, Japan

[73] Assignee: Fuji Photo Film Co., Ltd., Minami-ashigara, Japan

[21] Appl. No.: 65,017

[22] Filed: Aug. 9, 1979

[30] Foreign Application Priority Data

Aug. 9, 1978 [JP] Japan ..... 53-96937

[51] Int. Cl.[3] ..... B41M 5/16; B41M 5/22

[52] U.S. Cl. ..... 282/27.5; 427/150; 427/151; 428/307; 428/328; 428/331; 428/341; 428/914

[58] Field of Search ..... 106/21; 282/27.5; 427/150, 151, 152; 428/307, 411, 537, 913, 914, 328, 331, 341, 342

[56] References Cited

U.S. PATENT DOCUMENTS

| | | | |
|---|---|---|---|
| 2,972,547 | 2/1961 | Tien | 106/266 |
| 3,488,207 | 1/1970 | Vassiliades | 117/36.2 |
| 3,520,719 | 7/1970 | Horton | 282/27.5 |
| 3,540,914 | 11/1970 | Lin | 117/36.2 |
| 3,823,022 | 7/1974 | Thomas | 427/151 |
| 3,924,027 | 12/1975 | Saito et al. | 427/147 |
| 3,934,070 | 1/1976 | Kimura et al. | 428/342 |

*Primary Examiner*—Bruce H. Hess

*Attorney, Agent, or Firm*—Sughrue, Mion, Zinn, Macpeak and Seas

[57] ABSTRACT

A recording sheet capable of forming a color when brought into contact with an electron donating color former, which is prepared by coating a dispersion comprising (1) a polyvalent metal salt of an aromatic carboxylic acid, (2) a montmorillonite clay mineral, (3) zinc oxide, and (4) a binder, and which contains about 30 to 60 wt. % solid ingredients and has a viscosity of about 50 to 7,000 cps.

15 Claims, No Drawings

RECORDING SHEET

BACKGROUND OF THE INVENTION

1. Field of the Invention

This invention relates to a recording sheet and, more particularly, to a recording sheet capable of forming color when in contact with an almost colorless compound (hereinafter referred to as a color former).

2. Description of the Prior Art

Recording materials utilizing a coloration reaction between a color former and an adsorptive or reactive compound (hereinafter, referred to as a color developer) such as clay (e.g., acid clay, activated clay, attapulgite, zeolite, bentonite, kaolin, etc.), an organic acid (e.g., salicyclic acid, tannic acid, gallic acid, a phenolic compound, etc.), metal salt thereof, or an acidic polymer such as a phenol-formaldehyde resin are well known.

The color former is a material capable of providing an electron or accepting a proton from an acid to form a color, and the color developer is a material capable of accepting an electron or providing a proton.

As specific recording materials utilizing this phenomenon, there are pressure-sensitive copying papers (such as disclosed in U.S. Pat. Nos. 2,505,470, 2,505,489, 2,550,471, 2,548,366, 2,712,507, 2,730,456, 2,730,457, 3,418,250, Japanese Patent Applicaton (OPI) Nos. 28,411/74, (The term "OPI" as used herein refers to a "published unexamined Japanese patent application"), and 44,009/75), heat-sensitive recording papers (such as disclosed in Japanese Patent Publication No. 4,160/68, U.S. Pat. No. 2,939,009, etc.), electro-recording papers, etc. Further, there is also known a printing method of supplying a color former-containing ink to a color developer-coated sheet through a medium such as a stencil to obtain colored images (German OLS No. 1,939,624). In the case of utilizing the above-described phenomenon, a means is required to bring the color former and the color developer into contact with each other, such as application of pressure through a pencil or a typewriter key, heat, or the like.

As the most typical embodiment of recording materials, there can be illustrated pressure-sensitive copying paper. The color former layer of pressure-sensitive copying paper can be obtained by dissolving a color former in a solvent, dispersing the resulting solution in a binder or encapsulating it, and coating the composition on a support such as paper, a plastic film, resin-coated paper, etc.

On the other hand, a color developer sheet is obtained by dissolving or dispersing a color developer in a medium like water together with a binder, and coating on a support. In general, the color former and the color developer are coated on the same or opposite sides of a support, or on facing surfaces of different supports. Upon crushing the microcapsules by handwriting or typewriting the color former in the microcapsules is released and comes into contact with the color developer to form color. Thus, a record can be obtained according to the applied pressure.

As has been described above, many materials have been used as the color developer. However, clays, i.e., activated clay, acid clay, etc. are at present often employed as color developers and have the defect that they provide a color with poor light stability or water resistance. On the other hand, a phenol monomer or a phenol-formaldehyde resin has the defect as a color developer that the coated surface is liable to yellow.

It has been discovered that polyvalent metal salts of aromatic carboxylic acids are effective as a color developer without such defects (U.S. Pat. No. 3,934,070). That is, when the polyvalent metal salts of aromatic carboxylic acids are used as a color developer, the light resistance of the resulting color is excellent, the formed color will not disappear when in contact with water, and the color does not readily yellow even when exposed to light. However, there still remain several defects and improvements are needed.

For example, from the standpoint of performance, the coated surface is difficult to smooth in the case of coating a coating solution containing a comparatively low concentration of solids using air-knife coating and, color stain due to friction is liable to occur. In addition, an unsmooth surface produces unevenly colored images with poor resolving power upon handwriting or typewriting. Also, in production, there is the defect that solid ingredients must be incorporated in high concentrations so as to minimize, upon coating, the amount of water removed.

SUMMARY OF THE INVENTION

It is therefore an object of the present invention to provide a recording sheet having a smooth coated surface.

Another object of the present invention is to remove color stains.

A further object of the present invention is to improve the resolving power of colored images.

Still a further object of the present invention is to provide a coating solution which facilitates coating of a coating solution containing solid ingredients in high concentrations.

Still a further object of the present invention is to provide a recording sheet serving the above-described objects.

The above-described objects of the present invention have been attained by a recording sheet which comprises a layer of (1) a polyvalent metal salt of an aromatic carboxylic acid, (2) a montmorillonite clay mineral, (3) zinc oxide, and (4) a binder, and which contains about 30 to 60 wt % solid ingredients and has a viscosity of about 50 to 7,000 cps.

DETAILED DESCRIPTION OF THE INVENTION

The polyvalent metal salt is a salt of an aromatic carboxylic acid including those represented by following formula (I):

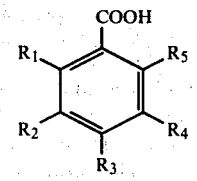

(I)

wherein $R_1$, $R_2$, $R_3$, $R_4$ and $R_5$ each represents a hydrogen atom, a halogen atom (e.g., Cl, F, Br, etc.), a hydroxy group, an amino group, an alkylamino group (the alkyl moiety of which may be straight chain, branched chain or cyclic), an acylamino group (including aliphatic or aromatic acylamino groups such as acetylamino, butyrylamino and benzamino), a nitro group, a formyl group, an alkyl group (including straight chain, branched chain or cyclic alkyl group such as methyl, ethyl, butyl, iso-amyl, octyl, nonyl, decyl, etc.), an aryl group (e.g., monocyclic or bicyclic aryl groups such as phenyl, naphthyl, etc.), an alkylaryl group (including monocyclic and bicyclic alkylaryl groups such as tolyl, amylphenyl, etc.), an aralkyl group (including monocyclic and bicyclic aralkyl groups such as benzyl, α-methylbenzyl, α,α-dimethylbenzyl, etc.) an alkoxy group (including straight chain, branched chain or cyclic alkoxy groups such as methoxy, ethoxy, butoxy, octyloxy, decyloxy, etc.), etc., or $R_1$ and $R_2$ or $R_3$ and $R_4$ may combine to form a 5- or 6-membered ring consisting of non-metallic atoms wherein the carbon atom containing substituents represented by $R_1$–$R_5$ each contain up to 18 carbon atoms. The 5- or 6-membered ring formed by the combination of $R_1$ and $R_2$ or $R_3$ and $R_4$ may be saturated or unsaturated and carbocyclic or heterocyclic.

Of the compounds of the above-described formula, particularly useful compounds are those wherein at least one of $R_1$ and $R_5$ represents a hydroxy group and the o- or p-position with respect to the hydroxy group is substituted by an alkyl group, an aryl group, an aralkyl group, or the like and preferably an aralkyl group.

As the specific examples of said aromatic carboxylic acid, there are illustrated 2,4-dichlorobenzoic acid, p-isopropylbenzoic acid, 2,5-dinitrobenzoic acid, p-t-butylbenzoic acid, N-phenylanthranilic acid, 4-methyl-3-nitrobenzoic acid, salicylic acid, m-hydroxybenzoic acid, p-hydroxybenzoic acid, 3,5-dinitrosalicylic acid, 5-t-butylsalicylic acid, 3-phenylsalicylic acid, 3-methyl-5-t-butylsalicylic acid, 3,5-di-t-amylsalicylic acid, 3-cyclohexylsalicylic acid, 5-cyclohexylsalicylic acid, 3-methyl-5-isoamylsalicylic acid, 5-isoamylsalicylic acid, 3,5-di-sec-butylsalicylic acid, 5-nonylsalicylic acid, 2-hydroxy-3-methylbenzoic acid, 2-hydroxy-5-t-butylbenzoic acid, 2,4-cresotinic acid, 5,5-methylenedisalicylic acid, acetaminobenzoic acid (o, m, p), 2,4-dihydroxybenzoic acid, 2,5-dihydroxybenzoic acid, anacardic acid, 1-naphthoic acid, 2-naphthoic acid, 1-hydroxy-2-naphthoic acid, 2-hydroxy-3-naphthoic acid, 2-hydroxy-1-naphthoic acid, thiosalicylic acid, etc. Preferable compounds include 3,5-di(α-methylbenzyl)salicylic acid, 3-(α-methylbenzyl)-5-(α,α-dimethylbenzyl)salicylic acid, 3-(4'-α',α'-dimethylbenzyl)phenyl-5-(α,α-dimethylbenzyl)salicylic acid, 3,5-di-t-butylsalicylic acid, 3,5-di-t-octylsalicylic acid, 3-cyclohexyl-5-(α,α-dimethylbenzyl)salicylic acid, 3-phenyl-5-(α,α-dimethylbenzyl)salicylic acid, 3,5-di(α,α-dimethylbenzyl)salicylic acid, etc.

As the metals capable of forming metal salts with the above-illustrated aromatic carboxylic acids, there are illustrated magnesium, aluminum, calcium, scandium, titanium, vanadium, chromium, manganese, iron, cobalt, nickel, copper, zinc, gallium, germanium, strontium, yttrium, zirconium, molybdenum, silver, cadmium, indium, tin, antimony, barium, tungsten, lead, bismuth, etc. Of these metals, zinc, tin, aluminum, magnesium, calcium, and the like are particularly effective, with zinc being the most effective.

The montmorillonite clay minerals used in combination with the polyvalent metal salts of the aromatic carboxylic acids are clay minerals such as acid clay, activated clay prepared by acid-processing acid clay, etc. and are represented by the formula of $X_m(Y^{2+}, Y^{3+})_{2-3}.Z_4O_{10}(OH)_2.SH_2O$ wherein X is K, Na, or Ca; $Y^{(2+)}$ is Mg, $Fe^{2+}$, $Mn^{2+}$, Ni, Zn, Li; $Y^{(3+)}$ is Al, $Fe^{3+}$, $Mn^{3+}$, $Cr^{3+}$, Z is Si or Al; the average value of m is $\frac{1}{3}$; S is the number of interlayer water). They have a larger base exchange capacity as compared with other clay minerals. Related descriptions are given in *Clay Handbook,* compiled by the Japanese Clay Society, and published by Gihodo Co., Ltd., p.80. Of these clay minerals, those which contain about 5 to 30 parts by weight, particularly about 10 to 20 parts by weight, aluminum per 100 parts by weight of silicon are preferred.

These montmorillonite clay minerals are used in an amount of about 10 to 10,000 parts, preferably about 10 to 5,000 parts and more preferably about 500 to 2,000 parts, per 100 parts by weight of the polyvalent metal salt of the aromatic carboxylic acid.

In the present invention, it is preferable to use a water-soluble polyvalent metal salt together with the polyvalent metal salt of the aromatic carboxylic acid. Specifically, such water-soluble salts are water-soluble salts of polyvalent metals such as zinc, aluminum, calcium, magnesium, etc. with, in particular, a strong acid. Specific examples thereof include zinc sulfate, aluminum sulfate, calcium sulfate, magnesium sulfate, zinc chloride, aluminum chloride, calcium chloride, magnesium chloride, etc. These are used in an amount of about 0.01 to 50 parts of metal, preferably about 0.05 to 20 parts and more preferably about 0.1 to 10 parts, per 100 parts by weight of the clay mineral.

The pH of the coating solution is desirably not more than about 10. If the pH is more than about 10, the viscosity of the coating solution becomes too high and light resistance of the formed color tends to deteriorate, thus such pH being not desirable. The pH is desirably not less than 5. If the pH is too low, there results coagulation of the binder.

Zinc oxide used in the present invention is generally referred to as zinc flower, and is produced from metal zinc (French process or indirect process) or from zinc ore (Americal process or direct process), or according to a wet process. Zinc oxide prepared according to any process can be used in the present invention. A preferable particle size of zinc oxide is not more than about 5μ, more preferably not more, than about 1μ, in terms of mean particle size.

Zinc oxide is used in an amount of about 1 to 1,000 parts, preferably about 2 to 500 parts, more preferably about 5 to 200 parts, per 100 parts by weight of the montmorillonite clay mineral.

The coating solution of the present invention can be prepared by, for example, crushing at least one of the polyvalent metal salt of the aromatic carboxylic acid, montmorillonite clay mineral, and zinc oxide using a ball mill, attritor, sand mill, etc.

In this crushing process, the combined use of a metal compound such as an oxide, hydroxide, silicate, carbonate, or the like of a metal selected from the group consisting of aluminum, calcium, magnesium, titanium, nickel, cobalt, manganese, iron, tin, copper, vanadium, and chromium provides more desirable effects such as reduction in viscosity of the coating solution, improvement of color-developing ability, etc. The combined use of aluminum compounds such as aluminum hydroxide is particularly desirable. These compounds are desirably used in an amount of about 1 to 1,000 parts, more preferably about 10 to 100 parts, per 100 parts of the clay mineral.

The crushing process is desirably conducted in a wet manner in the presence of water with a solid concentration of 30 to 60%. Particle size after the crushing process is not larger than about 10μ, preferably not larger than about 6μ.

In the crushing process, the combined use of a low molecular or high molecular dispersing agent or surface active agent having an anionic group (e.g., phosphoric acid, sulfonic acid, carboxylic acid, etc.) or a nonionic group such as a hydroxy group provides the advantage that a stable dispersion can be prepared in a short time.

In preparing the coating solution of the color developer, a binder is generally used. The binder is selected in view of film strength, dispersibility of the color developer, and influence on the color-developing ability of the color developer.

As water-soluble binders, there are illustrated water-soluble natural high molecular weight compounds such as proteins (e.g., gelatin, albumin, casein, etc.), starch (grain starch, α-starch, oxidized starch, etherified starch, esterified starch, etc.), cellulose (e.g., carboxymethyl cellulose, hydroxyethyl cellulose, etc.), saccharose (e.g., agar-agar, sodium alginate, carboxymethyl starch, gum arabic, etc.), and the like; and water-soluble synthetic high polymer compounds such as polyvinyl alcohol, polyvinyl pyrrolidone, polyacrylic acid, polyacrylamide, maleic acid copolymer, and the like.

As latexes, there are illustrated styrene-butadiene latex, acrylonitrile-butadiene latex, acrylic ester series latex, vinyl acetate series latex, methyl methacrylatebutadiene latex, carboxy-modified (e.g., acrylic acid) latexes of these, and the like. The latex type binders to be influenced by metal ions, and sufficient film strength as a binder for the aromatic carboxylic acid metal salt is difficult to obtain. However, they possess the merits of a low viscosity and an excellent water resistance.

Sufficient film strength can be obtained by previously uniformly mixing the latex with a nonionic compound to stabilize it. The nonionic compounds used are hydrophilic and include polyvinyl alcohol and nonionic surface active agents [for example, polyoxyethylene alkyl ether (e.g., polyoxyethylene lauryl ether, polyoxyethylene cetyl ether, polyoxyethylene stearyl ether, polyoxyethylene oleyl ether, etc.), polyoxytethylene alkylphenol ether (e.g., polyoxyethylene octylphenol ether, polyoxyethylene nonylphenol ether, etc.), sorbitan fatty acid ester (e.g., sorbitan monolaurate, sorbitan monostearate, sorbitan distearate, sorbitan monooleate, sorbitan sesquioleate, sorbitan trioleate, etc.), polyoxyethylene sorbitan fatty acid ester (e.g., polyoxyethylene sorbitan monolaurate, polyoxyethylene sorbitan monostearate, polyoxyethylene sorbitan monooleate, etc.), polyoxyethylene acyl ester (e.g., polyethylene glycol monolaurate, polyethylene glycol monostearate, polyethylene glycol distearate, polyethylene glycol monooleate, etc.), oxyethylene-oxypropylene block polymer, and fatty acid monoglyceride (e.g., glyceryl monostearate, glyceryl monooleate, etc.), and the like]. Polyvinyl alcohol (PVA) having a saponification degree of not more than 90 is desirable. As to nonionic surface active agents, those with an HLB of not less than 8 are desirable. These nonionic compounds are used in an amount of not less than about 0.1 part, preferably about 1 to 100 parts, per 100 parts of the latex (as solids).

On the other hand, water-soluble binders with, in particular, hydroxy groups are not readily influenced by metal ions, and hence they are desirable as a binder for the polyvalent metal salts of the aromatic carboxylic acids. Of these, starch and PVA are particularly preferable. Preferable PVA has a saponification degree of about 80 to 100, in particular about 90 to 100, and a polymerization degree of about 200 to 3,000, in particular about 500 to 2,000. However, independent use of these water-soluble binders provides a coating solution with a too high viscosity and deteriorates water resistance of the coated surface, though a sufficient film strength can be obtained. Therefore, it is necessary to use a latex in combination herewith. The latex binder has been described in detail above, and carboxymodified latexes like SBR latex are particularly preferable.

As to the proportion of latex (as solid ingredients) to the water-soluble binder about 10 to 1,000 parts by weight, preferably about 50 to 500 parts by weight, of the latex is used per 100 parts by weight of the water-soluble binder. The total amount of the binders is not more than 50 parts by weight, preferably not more than 20 parts by weight, per 100 parts by weight of the solid ingredients.

The amount of the binder to be used is a balance of the color-developing ability with the film strength, and generally the less binder the better as long as a suitable film is obtained.

The coating solution may further contain other color developers having the properties defined hereinbefore, such as clays, phenols, phenolic resin, organic acids (e.g., aromatic carboxylic acids, aliphatic polybasic carboxylic acids, etc.), etc. Suitable phenolic resins are disclosed in U.S. Pat. Nos. 3,663,256, 3,516,849, 3,455,721 and 3,672,935.

The coating solution of the present invention is prepared by incorporating solid ingredients in high contents, and is given specific properties to attain the objects of the present invention.

The total solid content of the coating solution is preferably about 30 to 60 wt% and preferably 40 to 55 wt%, and its viscosity ranges from about 50 to 7,000 cps (Brookfield 60 rpm) and preferably 60 to 6,000 cps at 25° C. The high content of solid ingredients in the coating solution facilitates drying in coating step, thus serving to reduce irregularities of the coated surface due to drying.

In addition, a proper viscosity facilitates the provision of a proper coating amount under high speed operation conditions using a typical coater of a blade coater, or the like, which enables improvement of productivity (the production yield for unit time), leading to reduction in cost of producing recording sheets.

The coating solution of the present invention can be coated by, for example, blade-coating, roll-coating, Billbrade-coating, curtain coating, etc. in place of air knife coating, as one layer or a plurality of layers at the same time.

The coating amount is generally about 0.03 to 6 g/m$^2$ as the polyvalent metal salt of the aromatic carboxylic acid, though it varies depending upon the kind of a pigment to be used. If it is too small, a sufficient color-developing ability cannot be obtained. On the other hand, the upper limit is primarily set for economic reasons rather than for the resulting performance.

The color former used in the recording sheet of the present invention capable of reacting with the color developer is not particularly limited. As the specific compounds of the color former, there are illustrated (1) triarylmethane compounds such as 3,3-bis(p-dimethylaminophenyl)-6-dimethylaminophthalide (or crystal violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3yl)phthalide, 3,3-bis-(1,2-dimethylindol-3-yl)- 5-dimethylaminophthalide, 3,3-bis (1,2-dimethylindol-3-yl)-6-dimethylaminophthalide, 3,3-bis(9-ethylcarbazol-3-yl)-5-dimethylaminophthalide, 3,3-bis(2-phenlindol-3-yl)-5-dimethylaminophthalide, 3- p-dimethylaminophenyl-3-(1-methylpyrrol-2-yl)-6-dimethylaminophthalide, etc.; (2) diphenylmethane compounds such as 4,4'-bis-dimethylaminobenzhydrin benzyl ether, N-halophenyl leucoauramine, N-2,4,5-trichlorophenyl leucoauramine, etc.; (3) xanthene compounds such as rhodamine B-anilinolactam, rhodamine B-p-nitroanilinolactam, rhodamine B-p-chloroanilinolactam, 2-dimethylamino-7-methoxyfluoran, 2-diethylamino-7-methoxyfluoran, 3-diethylamino-7-methoxyfluoran, 3-diethylamino-7-chlorofluoran, 2-diethylamino-3-chloro-7-methylfluoran, 7-diethylamino-2,2-dimethylfluoran, 7-diethylamino-3-acetylmethylaminofluoran, 7-diethylamino-3'-methylaminofluoran, 3-diethylamino-6-methyl-7-anilinofluoran, 3,7-diethylaminofluoran, 3-diethylamino-7-dibenzylaminofluoran, 3-diethylamino-7-methylbenzylaminofluoran, 3-diethylamino-7-chlorethylmethylaminofluoran, 3-diethylamino-7-chloroethylmethylaminofluoran, 3-diethylamino-7-diethylaminofluoran, etc.; (4) thiazine compounds such as benzoyl leucomethylene blue, p-nitrobenzoyl leucomethylene blue, etc.; (5) spiro compounds such as 3-methylspiro-dinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)-spiro-pyran, 3-propyl-spiro-dibenzopyran, etc.; and the mixtures thereof. These are selected according to the use and desired properties. Of these, triarylmethane compounds, in particular crystal violet lactone, provide great effects of the present invention.

The color former is coated on a support by dissolving it in a solvent and encapsulating the resulting solution, or by dispersing in a binder solution.

As the solvent, natural or synthetic oils can be used alone or in combination. Examples of the solvent include cotton seed oil, lamp oil, paraffin, naphthenic oil, alkylated biphenyl, alkylated terphenyl, alkylated naphthalene, diarylethane, triarylmethane, chlorinated paraffin, etc. As to the processes for encapsulation, there are a process of utilizing coacervation of hydrophilic colloid sol described in U.S. Pat. Nos. 2,800,457 and 2,800,458, a process of interfacial polymerization described in British Pat. Nos. 867,797, 950,443, 989,264, 1,091,076, etc., and the like.

Effects obtained by the present invention are enumerated below.

First, a smoothly coated surface can be obtained.

Second, color stain due to friction is reduced.

Third, color images are obtained with high resolving power.

Fourth, the present invention enables coating of a coating solution containing solid ingredients in high concentrations.

These effects of the recording material of the present invention were tested with the following color former sheet.

Color Former Test Sheet

Microcapsules containing a color former were prepared by the process described in, for example, U.S. Pat. No. 2,800,457. A specific example of the process is described below. In the following descriptions all parts are by weight.

10 parts of acid-processed pig skin gelatin and 10 parts of gum arabic were dissolved in 400 parts of 40° C. water, and 0.2 part of Turkey red oil was added thereto as an emulsifier. 40 parts of color former oil was emulsified and dispersed therein. The color former oil was prepared by dissolving crystal violet lactone in diisopropylnaphthalene in a concentration of 4%.

When the size of the oil droplets became 5μ on the average, the emulsification was discontinued, and 40° C. water was added thereto to make the total 900 parts, followed by continuing stirring. Then, 10 wt % acetic acid was added thereto to adjust the pH of the solution to 4.4–4.6, thus causing coacervation. Stirring was further continued and, after 20 minutes, the system was cooled with ice water to cause gelation of the coacervate film deposited around the oil droplets.

When the solution temperature became 20° C., 7 parts of 37 wt% formalin was added thereto and, at 10° C., 15 wt% caustic soda aqueous solution was added thereto to adjust the pH to 9. Subsequently, the solution was heated for 20 minutes under stirring to a solution temperature of 50° C.

The thus obtained microcapsule dispersion was cooled to 30° C., and coated on a 40 g/m$^2$ paper in an amount of 6g (as solid ingredients)/m$^2$, followed by drying.

Thus, there were obtained microcapsule sheets containing crystal violet lactone as a color former.

The present invention will now be described in more detail by the following non-limiting examples.

EXAMPLE 1

20 Parts of zinc oxide and 100 parts of acid clay were dispersed in 200 parts of water containing 1 part of sodium hexametaphosphate using a Kady mill, then the pH of the dispersion was adjusted to 7 with a 20% sodium hydroxide aqueous solution. To this dispersion was added 10 parts of zinc, 3,5-di-tert-butylsalicylate, and subjected to crushing for 1 hour using an attritor. To the thus obtained dispersion were added 50 parts of a 10% polyvinyl alcohol (PVA 117) aqueous solution and 20 parts of carboxy-modified SBR latex (containing 48% solid ingredients), followed by uniform stirring and mixing to obtain a coating solution of the present invention. This coating solution contained 36% solid ingredients and had a viscosity of 550 cps. This coating solution was coated on a 50 g/m$^2$ paper in an amount of 5.5 g (as solids)/m$^2$ using a blade coater, then dried to obtain a recording sheet.

EXAMPLE 2

10 Parts of zinc 3,5-di-α-methylbenzylsalicylate, 10 parts of zinc oxide, 60 parts of acid clay, 1 part of styrene oligomer, and 40 parts of aluminum hydroxide (mean particle size not more than 3μ)were dispersed, using a Kady mill in 170 parts of water containing 1 part of sodium hexametaphosphate. This dispersion was subjected to a sand grinder (32 G type; made by Igarashi Machine Co.) with a delivery rate of 100 l/hr. To the thus obtained dispersion were added 50 parts of a 10% PVA (PVA 117) aqueous solution and 20 parts of carboxy-modified latex (concentration of solids: 48%), followed by uniform stirring and mixing to obtain a coating solution of the present invention. This coating solution contained 38% solid ingredients and had a viscosity of 430 cps. This solution was coated on a 50 g/m² paper in an amount of 5.5 g (as solids)/m² using a blade coater, then dried to obtain a recording sheet.

COMPARATIVE EXAMPLE 1

A coating solution for comparison was prepared in the same manner as in Example 1 except for omitting zinc oxide and adding 250 parts of water after the treatment using the attritor. This coating solution contained 20% solid ingredients, and had a viscosity of 12 cps. This solution was coated on a 50 g/m² paper in an amount of 5.5 g (as solids)/m² using an air knife coater, then dried to obtain a recording sheet.

COMPARATIVE EXAMPLE 2

A coating solution for comparison was prepared in the same manner as in Example 2 except for excluding zinc oxide and adding 280 parts of water after the treatment by means of sand grinder. This coating solution contained 20% solid ingredients, and had a viscosity of 12 cps. This solution was coated on a 50 g/m² paper in an amount of 5.5 g (as solids)/m² using an air knife coater, and dried to obtain a recording sheet.

Comparison Test

[Comparison of Color Stain Caused by Friction]

Microcapsule sheets containing crystal violet lactone were superposed on the recording sheets obtained in preceding Examples and Comparative Examples, and were rubbed with each other for 1 minute applying a load of 50 g/cm² to compare color stains on the recording sheets. The results thus obtained are set forth in Table 1.

[Comparison of Colored Images Formed by Typewriting]

Microcapsule sheets containing crystal violet lactone were superposed on the recording sheets obtained in preceding Examples and Comparative Examples, and were typewritten with a low key pressure to compare color density and distinctness of colored letters. The results thus obtained are also given in Table 1.

TABLE 1

| | Friction Stain | Image Quality | |
|---|---|---|---|
| | | Density | Distinctness |
| Example 1 | slight | good | good |
| Comparative Example 1 | serious | good | slightly poor |
| Example 2 | slight | good | good |
| Comparative Example 2 | serious | good | slightly poor |

The above results show the outstanding effects of the present invention.

While the invention has been described in detail and with reference to specific embodiments thereof, it will be apparent to one skilled in the art that various changes and modifications can be made therein without departing from the spirit and scope thereof.

What is claimed is:

1. A recording sheet capable of forming color when brought into contact with an electron donating color former, which comprises a support having coated thereon a layer prepared from a coating composition comprising a polyvalent metal salt of an aromatic carboxylic acid, a montmorillonite clay mineral containing about 10 to 20 parts by weight of aluminum per 100 parts by weight of silicon, zinc oxide, and a binder and which contains about 30 to 60 wt% solid ingredients and has a viscosity of about 50 to 7,000 cps.

2. The recording sheet of claim 1, wherein said polyvalent metal salt of an aromatic carboxylic acid is a salt of an aromatic carboxylic acid represented by the formula (I)

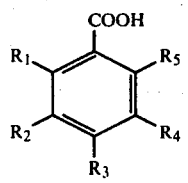

(I)

wherein $R_1$, $R_2$, $R_3$, $R_4$ and $R_5$ each represents a hydrogen atom, a halogen atom, a hydroxy group, an amino group, an alkylamino group, an acylamino group, a nitro group, a formyl group, an alkyl group, an aryl group, an alkylaryl group, an aralkyl group, an alkoxy group, or $R_1$ and $R_2$ or $R_3$ and $R_4$ may combine to form a 5- or 6-membered ring.

3. The recording sheet of claim 2, wherein at least one of $R_1$ and $R_5$ represents a hydroxy group and the o- or p-position with respect to the hydroxy is substituted by an alkyl group, an aryl group or an aralkyl group.

4. The recording sheet of claim 1, wherein said montmorillonite clay is represented by the formula $$x_m(Y^{2+}, Y^{3+})_{2-3}.\ Z_4O_{10}(HO)_2.SH_2O$$

wherein X is K, Na, or Ca; $Y^{(2+)}$ is Mg, $Fe^{2+}$, $Mn^{2+}$, Ni, Zn, Li; $Y^{(3+)}$ is Al, $Fe^{3+}$, $Mn^{3+}$, $Cr^{3+}$; Z is Si or Al; the average of m is 1/3; S is the number of interlayer water.

5. The recording sheet of claim 1, wherein said montmorillonite clay mineral is present in said layer in an amount of about 10 to 10,000 parts by weight per 100 parts by weight of said aromatic carboxylic acid salt.

6. The recording sheet of claim 1, wherein said composition additionally contains a water soluble salt selected from the group consisting of zinc, aluminum, calcium and magnesium salts of strong acids.

7. The recording sheet of claim 1, wherein said coating composition has a pH of not more than about 10.

8. The recording sheet of claim 1, wherein said zinc oxide is present in an amount of about 1 to 1,000 parts by weight per 100 parts by weight of said montmorillonite clay mineral.

9. The recording sheet of claim 1, wherein the solids in said layer have a particle size not larger than about 10μ.

10. The recording sheet of claim 1, wherein said binder is a combination of a polymer containing a hydroxy group and a latex.

11. The recording sheet of claim 10, wherein said polymer containing a hydroxy group is a starch or polyvinyl alcohol having a saponification degree of about 80 to 100 and a polymerization degree of about 200 to 3,000.

12. The recording sheet of claim 12, wherein said latex is a carboxy-modified SBR latex.

13. The recording sheet of claim 1, wherein said binder is present in an amount of not more than about 50 parts by weight per 100 parts by weight of the solids making up said layer.

14. The recording sheet of claim 1, wherein said composition is coated on a support in an amount of about 0.03 to 6 g aromatic carboxylic acid salt per square meter.

15. In a recording material comprising an electron donating color former and an electron accepting color developer dispersed in one or more layers on one or more supports, the improvement which comprises a color developer layer prepared from a coating composition comprising a polyvalent metal salt of an aromatic carboxylic acid, montmorillonite clay mineral, zinc oxide and a binder and which contains about 30 to 60 wt% solid ingredients and has a viscosity of about 50 to 7,000 cps.

* * * * *